US010040088B2

(12) United States Patent
Beranger et al.

(10) Patent No.: US 10,040,088 B2
(45) Date of Patent: Aug. 7, 2018

(54) FLUID DISPENSER MEMBER WITH TRANSPARENT OR TRANSLUCENT DIP TUBE

(71) Applicant: APTAR FRANCE SAS, Le Neubourg (FR)

(72) Inventors: Stéphane Beranger, Surtauville (FR); Frédéric Duquet, Crespieres (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/328,615

(22) PCT Filed: Jul. 23, 2015

(86) PCT No.: PCT/FR2015/052036
§ 371 (c)(1),
(2) Date: Jan. 24, 2017

(87) PCT Pub. No.: WO2016/012722
PCT Pub. Date: Jan. 28, 2016

(65) Prior Publication Data

US 2017/0216866 A1 Aug. 3, 2017

(30) Foreign Application Priority Data

Jul. 25, 2014 (FR) ..... 14 57224

(51) Int. Cl.
*B05B 11/00* (2006.01)
*B05B 15/00* (2018.01)
*B05B 15/30* (2018.01)

(52) U.S. Cl.
CPC ..... *B05B 11/3064* (2013.01); *B05B 11/3001* (2013.01); *B05B 11/3047* (2013.01); *B05B 15/005* (2013.01); *B05B 15/30* (2018.02)

(58) Field of Classification Search
CPC ... B05B 15/005; B05B 15/006; B05B 15/007; B65D 1/323; B65D 83/32;
(Continued)

(56) References Cited

U.S. PATENT DOCUMENTS 3,061,202 A * 10/1962 Tyler ..... B05B 1/12 222/341
3,159,318 A * 12/1964 Green ..... B65D 83/14 222/402.18
(Continued)

FOREIGN PATENT DOCUMENTS

JP 03-240655 A 10/1991
JP 08-299863 A 11/1996
(Continued)

OTHER PUBLICATIONS

International Search Report for PCT/FR2015/052036 dated Nov. 11, 2015 [PCT/ISA/210].
(Continued)

*Primary Examiner* — Patrick M Buechner
(74) *Attorney, Agent, or Firm* — Sughrue Mion, PLLC

(57) ABSTRACT

A fluid dispenser member, such as a pump, having a body (11) for mounting in the opening of a fluid reservoir so as to take fluid therefrom. The body (11) has a fluid chamber (15) that defines a fluid inlet in the form of a socket (12). The dispenser member includes a dip tube (2) for extending into the fluid reservoir so as to take fluid therefrom, the dispenser member further having a reducer sleeve (3) that internally receives an end (21) of the dip tube (2), and that is engaged axially in the socket (12) of the body (11), such that fluid communication is established between the dip tube (2) and the chamber (15) of the body (11). The dip tube (2) presents an outside diameter less than 1 mm and is made of a material that is transparent or translucent.

29 Claims, 4 Drawing Sheets

(58) Field of Classification Search
CPC ..... B65D 2231/004; B65D 2588/545; B67D 1/0802; B67D 3/0064; B67D 2001/0824; B67D 2001/0825; F17C 2223/045; F17C 2223/047; F17C 2225/045; F17C 2225/047; G01F 11/028
USPC ..... 222/464.1–464.7; 138/109; 285/330, 285/332
See application file for complete search history.

(56) References Cited

U.S. PATENT DOCUMENTS 3,266,678 A * 8/1966 Green ..... B65D 83/14 222/402.24
3,311,274 A * 3/1967 Green ..... B65D 83/32 138/115
3,545,475 A * 12/1970 Johnson, Jr. ..... B67D 1/0802 137/212
3,837,661 A * 9/1974 Phillippi ..... B23B 31/14 279/131
4,116,370 A * 9/1978 Spitzer ..... B65D 83/14 137/38
5,072,860 A * 12/1991 Dobbs ..... B05B 11/3045 215/276
5,303,867 A * 4/1994 Peterson ..... B05B 1/3436 222/207
7,718,132 B2 5/2010 Thomson et al.
8,646,245 B2 * 2/2014 Behar ..... B05B 11/0097 53/133.2
2012/0223104 A1 * 9/2012 Bertin ..... B05B 11/3042 222/183
2013/0125914 A1 * 5/2013 Battermann ..... A61K 8/345 132/202
2014/0138409 A1 * 5/2014 Beranger ..... B05B 11/3025 222/321.2
2014/0175122 A1 * 6/2014 Crawford ..... B05B 11/0037 222/78

FOREIGN PATENT DOCUMENTS

JP 11-019540 A 1/1999
JP 2001-205146 A 7/2001
JP 2001-276683 A 10/2001
WO 2014/080116 A1 5/2014

OTHER PUBLICATIONS

Written Opinion for PCT/FR2015/052036 dated Nov. 11, 2015 [PCT/ISA/237].
International Preliminary Examination Report for PCT/FR2015/052036 dated Jun. 22, 2016 [PCT/ISA/409].
International Preliminary Report on Patentability, issued in counterpart International application No. PCT/FR2015/052036.

* cited by examiner

FLUID DISPENSER MEMBER WITH TRANSPARENT OR TRANSLUCENT DIP TUBE

CROSS REFERENCE TO RELATED APPLICATIONS

This application is a National Stage of International Application No. PCT/FR2015/052036 filed Jul. 23, 2015, claiming priority based on French Patent Application No. 1457224 filed Jul. 25, 2014, the contents of all of which are incorporated herein by reference in their entirety.

The present invention relates to a fluid dispenser member, such as a pump, comprising a body for mounting in the opening of a fluid reservoir so as to take fluid therefrom, the body comprising a fluid chamber that defines a fluid inlet in the form of a socket, the dispenser member including a dip tube for extending into the fluid reservoir so as to take fluid therefrom. Such a dispenser member may find an application in the fields of perfumery, cosmetics, and pharmacy in order to dispense various fluids, such as fragrance, lotions, and more particularly fluids that have little viscosity.

For a long time, is has been customary to fit pumps and valves with dip tubes for delivering fluid from the bottom of a fluid reservoir to the fluid inlet of the pump or valve. Fluid from the reservoir is delivered to a chamber of the pump or of the valve by suction after each occasion that fluid is dispensed, while the actuator rod is being relaxed, which actuator rod is generally fitted with a pusher on which the user presses by means of a finger, such as the index finger.

In the field of perfumery for example, it is customary to use dip tubes made of translucent polyethylene or polypropylene having an outside diameter that is about 1.2 millimeters (mm). Specifically, most pumps in the field of perfumery include an intake socket, also referred to as a "tube holder", having an inside diameter that is 1.2 mm in practically standard manner. As a result, there is no option for selecting the diameter of the dip tube, which diameter has to be 1.2 mm. However, because they are translucent and not transparent, conventional dip tubes made of polyethylene or polypropylene remain visible to the naked eye through the reservoir and the fluid, when said reservoir and fluid are transparent, as often applies with fragrance bottles and fragrance. In order to mitigate this esthetically unpleasing affect associated with the dip tube being visible. Document U.S. Pat. No. 7,718,132 proposes making the dip tube out of a specific material, namely a fluoropolymer, having a refractive index that is practically identical to the refractive index of the fragrance, such that the dip tube, once filled with fluid, is not visible to be naked eye through the reservoir and the fluid. However, the use of fluoropolymer to make the dip tube presents a major drawback, namely its cost, since fluoropolymers are expensive materials. Furthermore, the conventional method of manufacturing by extrusion is more difficult to perform than with conventional polyethylene or polypropylene.

An object of the present invention is to remedy the above-mentioned drawbacks of the prior art by defining a dispenser member having a dip tube that is invisible or almost invisible when it is immersed in the fluid in the reservoir, and even when it is above the surface level of the fluid stored in the reservoir. Furthermore, the dip tube should avoid using expensive fluoropolymer, or at least reduce the quantity of fluoropolymer that is used. Another object of the present invention is to provide an invisible dip tube that can be made out of a material other than fluoropolymer. Still another object of the present invention is to provide a dip tube that can be assembled with the pump on conventional assembly lines. Still another object of the present invention is to be able to mount the dip tube of the invention on a conventional dispenser member (pump or valve) that presents an intake socket having an inside diameter that is the standard 1.2 mm.

To achieve these various objects, the present invention proposes that the dispenser member further comprises a reducer sleeve that internally receives an end of the dip tube, and that is engaged axially in the socket of the body, such that fluid communication is established between the dip tube and the chamber of the body. Furthermore, the dip tube presents an outside diameter that is less than 1 mm, and the dip tube is made of a material that is transparent or translucent. Advantageously, the dip tube presents an outside diameter lying in the range about 0.8 mm to 0.6 mm.

The reducer sleeve thus constitutes an additional part having a diameter-reducing function that makes it possible to use dip tubes of various diameters, and preferably of small diameter, independently of the standard inside diameter of 1.2 mm of the intake socket of the dispenser member. Consequently, the reducer sleeve of the invention offers freedom of choice with regard to the outside diameter of the dip tube, such that it may be considerably smaller than the standard inside diameter of 1.2 mm of the intake socket of the dispenser member. The dip tube may present an outside diameter that is smaller than 1 mm, and preferably equal to about 0.4 mm. Given that the outside diameter is small, the quantity of material constituting the dip tube is greatly reduced, and, by way of example, with an outside diameter of 0.6 mm, the volume of material used is reduced by a factor of about 7 to 8, which is considerable, in particular when the material used is an expensive fluoropolymer. In addition, the use of a dip tube of small diameter also makes it possible to reduce the number of priming strokes necessary to fill the chamber on first use, given that the volume of the dip tube is considerably smaller than the volume of a conventional dip tube having an outside diameter that is 1.2 mm.

In an advantageous embodiment, the reducer sleeve is radially deformable, such that engaging it in the socket increases the clamping of the reducer sleeve around the dip tube. During assembly, the dip tube is initially inserted into the reducer sleeve without force-fitting, then the reducer sleeve with its "pre-engaged" dip tube is force-fitted into the intake socket of the pump or of the valve, which causes the reducer sleeve to deform radially, thereby increasing its clamping around the dip tube, which is thus anchored inside the reducer sleeve. In order to make the reducer sleeve radially deformable, several embodiments have been envisaged. Firstly, the reducer sleeve could be made out of a flexible or deformable material, such as polyethylene or polypropylene. In addition or in a variant, the reducer sleeve could be made with an axial slot that advantageously extends over a fraction of its height. In a variant or in addition, provision could be made for the reducer sleeve to define an outer bearing surface that is engaged with an inner bearing surface of the socket, the outer bearing surface being stepped, thereby defining at least two sections having diameters that are different. In this way, greater clamping can be obtained at the section of greatest diameter, which section is deformed to a greater extent while being force-fitted in the intake socket of the dispenser member. In addition or in a variant, provision could be made for the reducer sleeve to form a transverse edge against which the dip tube is deformed and thus held.

In a practical and advantageous embodiment, the reducer sleeve comprises: a hollow sheath in which the end of the dip tube is received, the hollow sheath coming into radial engagement in the socket; an insertion cone for making it easier to insert the dip tube into the sheath; a bearing collar that comes into axial abutment against the socket. Such a reducer sleeve can easily be used on conventional assembly lines with minimum alteration. Specifically, the dip tube can easily be inserted into the insertion cone, and the bearing collar makes it possible to hold or to push the reducer sleeve inside the intake socket or tube holder of the pump or of the valve. In order to impart the necessary radial deformability, provision may be made for only the sheath to be slotted axially, without affecting either the insertion cone or the bearing collar. In a variant, it is also possible for all three of the collar, the cone, and the sheath to be slotted axially. However, the axial slot preferably does not extend right through.

In another advantageous aspect of the present invention, the reducer sleeve includes an engagement cone, and the socket includes an insertion bevel for making it easier to interfit the sleeve in the socket.

Instead of, or in addition to, the sleeve being clamped radially around the dip tube, it is also possible to bond the dip tube in the reducer sleeve, or to bond the reducer sleeve around the dip tube. It is also possible to envisage that the reducer sleeve is overmolded on the dip tube.

Naturally, the dip tube is already barely visible, merely because of its small diameter that makes it difficult to see inside a fluid reservoir. If necessary, or if so desired, the dip tube may also be made more invisible by making it out of a transparent or translucent material.

The present invention also defines a method of assembling a dispenser member as defined above, the reducer sleeve being radially deformable, such that engaging it in the socket increases the clamping of the reducer sleeve around the dip tube, the method comprising firstly inserting the dip tube substantially without friction into the reducer sleeve, then secondly engaging the reducer sleeve with its dip tube in the socket. Given that the dip tube presents a small diameter, it also presents greater flexibility, and consequently a certain degree of fragility. In order to avoid damaging it while inserting it into the reducer sleeve, it is thus preferable to avoid inserting it by force, and on the contrary inserting it gently.

The spirit of the invention resides in using a dip tube of diameter that is smaller than the almost-standard 1.2 mm, so as to reduce its visibility or its visual perception inside a fluid reservoir. To do this, the present invention proposes using a reducer sleeve that makes it possible to make the transition from the small-diameter dip tube of the invention and fasten it in a conventional intake socket of 1.2 mm.

The invention is described below in greater detail with reference to the accompanying drawings, which show several embodiments of the invention as non-limiting examples.

Figure 1:
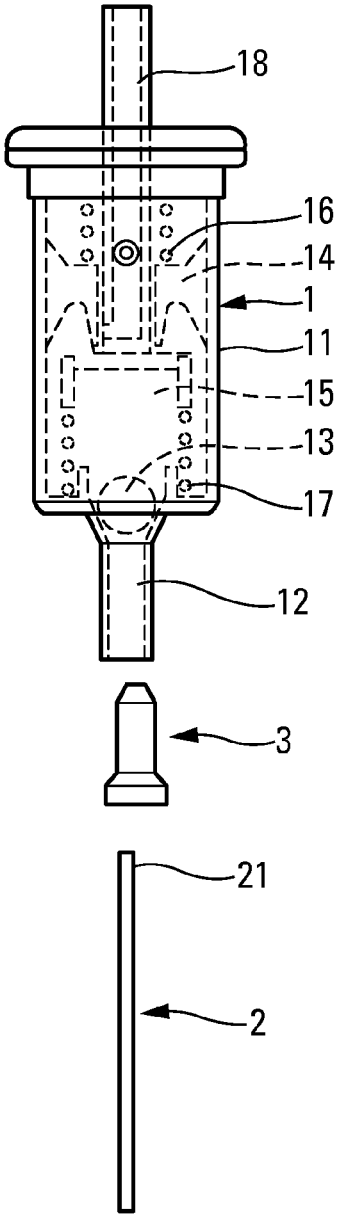
FIG. 1 is a partially transparent exploded view of a dispenser member of the invention.
Figures 3A, 3B, 4A, 4B:
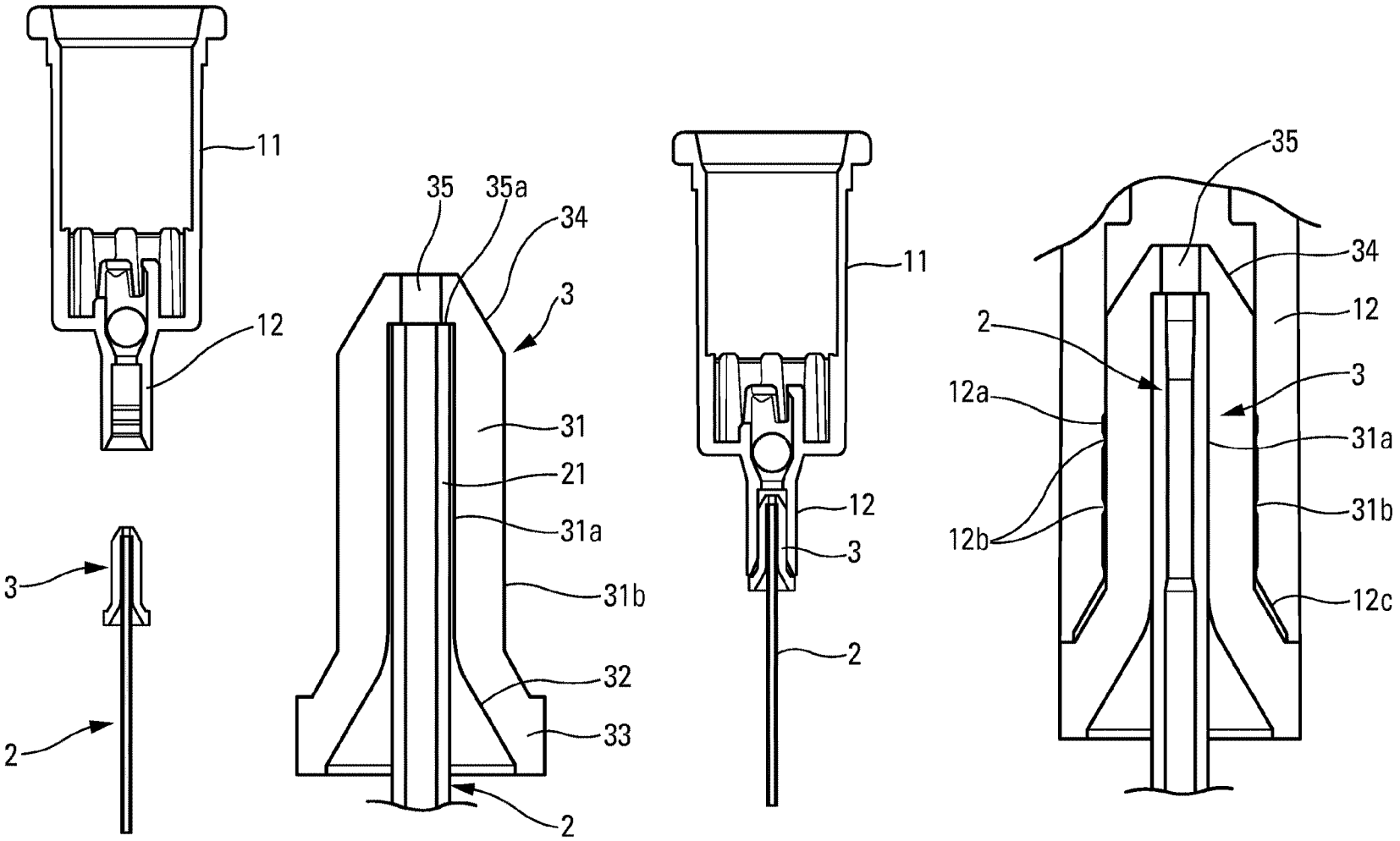
Figure 5A:
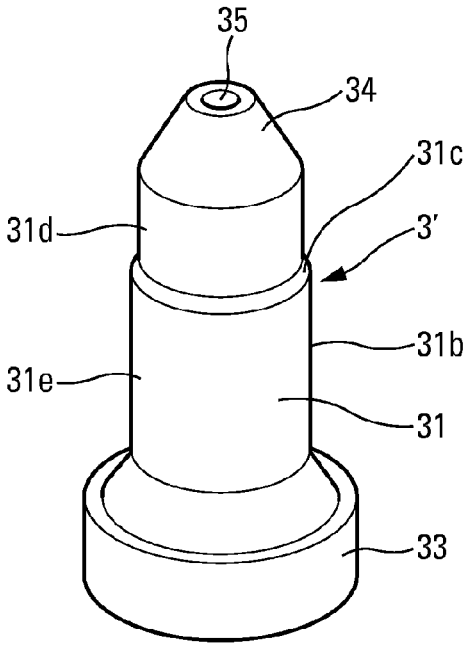
Figure 5B:
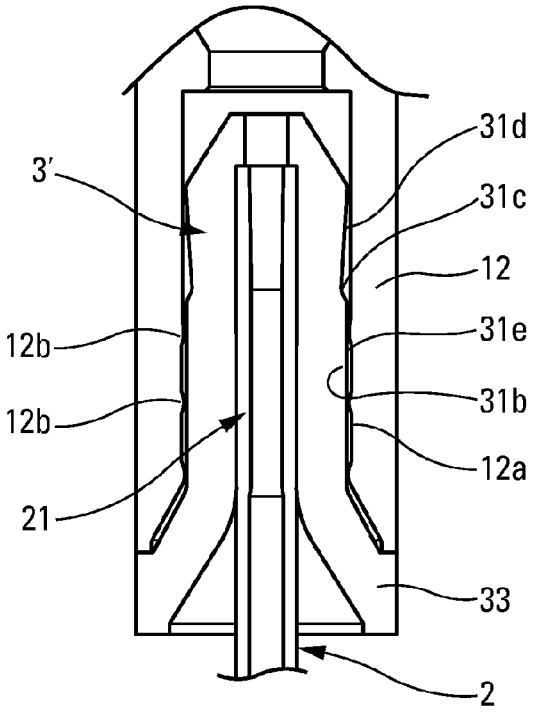
Figure 6:
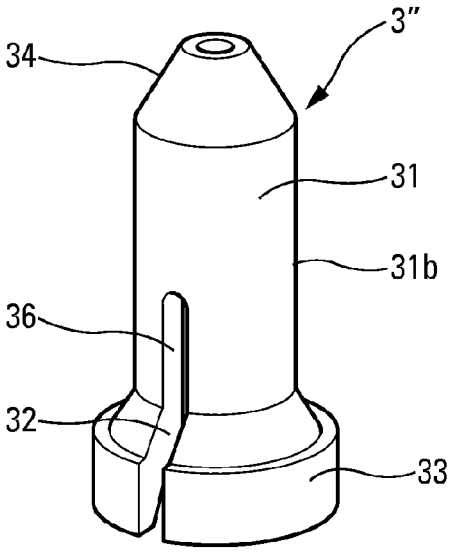
Figure 7:
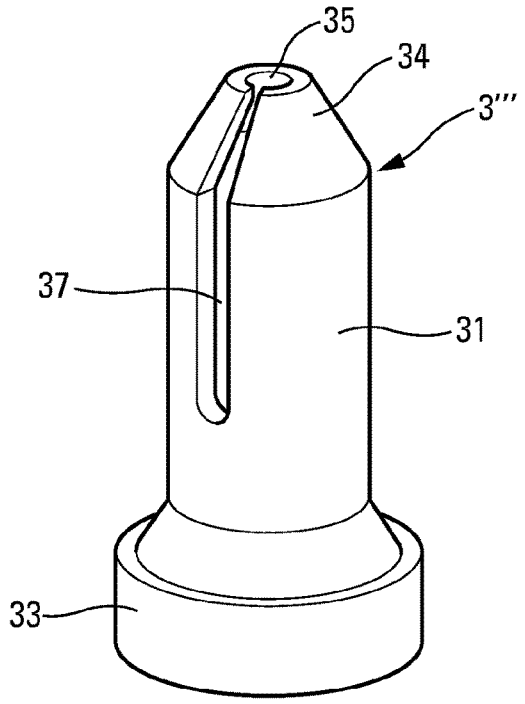
Figure 8A:
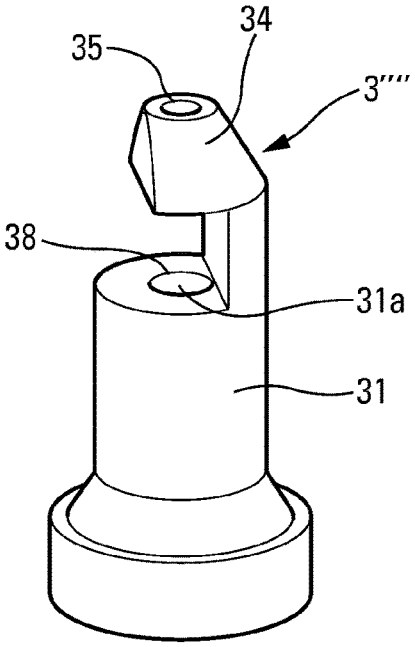
Figure 8B:
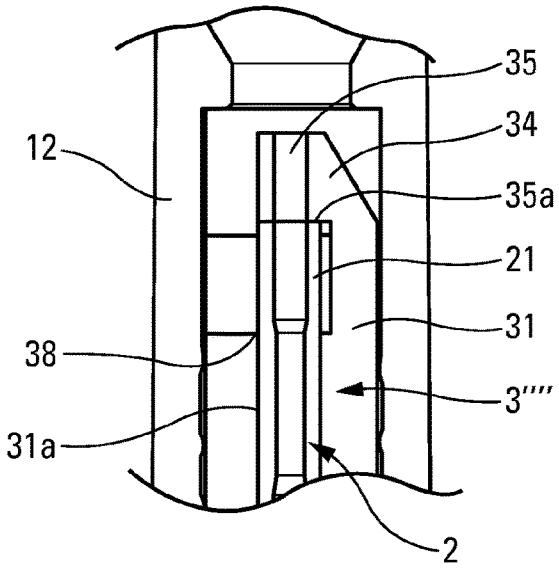

FIG. 3*a* is an exploded section view of the FIG. 1 dispenser member with the dip tube engaged in the reducer sleeve;

FIG. 3*b* is a very greatly enlarged view of the FIG. 3*a* reducer sleeve with the dip tube engaged;

FIG. 4*a* is a view similar to the view in FIG. 3*a* with the reducer sleeve engaged in the socket of the dispenser member;

FIG. 4*b* is a greatly enlarged view of the FIG. 4*a* sleeve, engaged in the socket of the dispenser member;

FIG. 5*a* is a greatly enlarged perspective view of a reducer sleeve in a second embodiment of the invention;

FIG. 5*b* is a vertical section view through the FIG. 5*a* reducer sleeve, engaged in an intake socket and receiving a dip tube;

FIG. 6 is a greatly enlarged perspective view of a reducer sleeve in a third embodiment of the invention;

FIG. 7 is a greatly enlarged perspective view of a reducer sleeve in a fourth embodiment of the invention;

FIG. 8*a* is a greatly enlarged perspective view of a reducer sleeve in a fifth embodiment of the invention; and FIG. 8*b* is a vertical section view through a portion of the FIG. 8*a* reducer sleeve, engaged in a socket and receiving an end of a dip tube.

Figure 2:
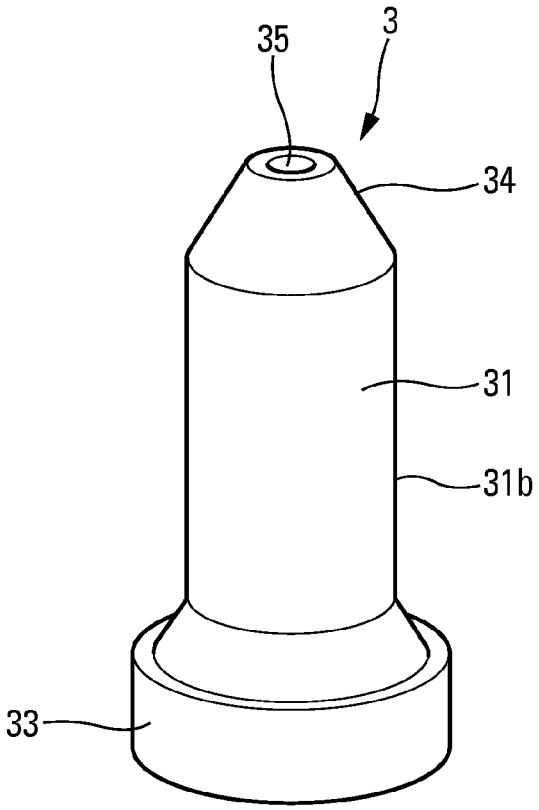
FIG. 2 is a very greatly enlarged perspective view of the FIG. 1 reducer sleeve in a first embodiment.

Reference is made firstly to FIGS. 1 and 2 which show a dispenser member 1 that is shown in entirely diagrammatic manner. The dispenser member is a pump, but it could equally well be a valve. The pump includes a pump body 11 that defines a fluid inlet in the form of an intake socket 12 having an inside diameter that is 1.2 mm, since this is practically the standard for pumps used in the field of perfumery. Inside the body 11, the pump defines a chamber 15 that, upstream, communicates selectively with the intake socket 12 through an inlet valve member 13 that may be in the form of a ball. Downstream, the chamber 15 communicates with a valve rod or an actuator rod 18 on which there is mounted a piston 14 that slides in leaktight manner inside a cylinder formed by the body 11. A return spring 17 urges the actuator rod 18 into its rest position, while a pre-compression spring 16 may urge the piston 14 into a position in which it closes a side opening of the actuator rod. This is only one particular type of pump, but it is possible to use any type of pump or valve in the context of the present invention, in so far as it includes an intake socket 12 for receiving a conventional dip tube. Although not shown, the free end of the actuator rod is generally fitted with a pusher on which the user presses so as to move the actuator rod inside the body 11, so as to put the fluid stored in the chamber 15 under pressure. The piston 14 thus moves both in the body 11 and on the rod 18, so that the fluid under pressure may be forced through the actuator rod and be dispensed via the pusher. Once the pressure on the pusher is relaxed, the actuator rod is returned into its rest position by the return spring 17, which creates suction inside the chamber, causing fluid to be sucked up through the intake socket 12. This mode of operation is entirely conventional for a manual pump in the fields of perfumery, cosmetics, and pharmacy. The dispenser member 1 is for receiving a conventional dip tube having an outside diameter that corresponds to the inside diameter of the intake socket 12, namely 1.2 mm in almost-standard manner. Conventional dip tubes are made of polyethylene or of polypropylene, or even of fluoropolymer when it is desired for the dip tube to be invisible in the reservoir.

In the invention, the dispenser member 1 is fitted with a dip tube 2 having an outside diameter that is less than 1 mm, advantageously less than 0.6 mm, and preferably equal to about 0.4 mm. Naturally, in the context of the invention, it is possible to make a dip tube having an outside diameter lying in the range 0.6 mm to 1 mm. Below 0.4 mm, manufacture becomes more complicated, but is nevertheless possible down to 0.2 mm. The dip tube 2 can be made of any material, such as polyethylene or polypropylene, for example. It is also possible to make it out of fluoropolymer, as described in Document U.S. Pat. No. 7,718,132. Specifically, despite the high cost of fluoropolymers, it is possible to make the dip tube of the present invention at low cost, as a result of the considerable reduction in the quantity of material constituting the dip tube.

As a function of the inside and outside diameters of a dip tube having a height of 100 mm, the table below shows the internal volume of the dip tube and the quantity of material constituting the dip tube.

| Inside Ø (mm) | Internal volume ($mm^3$) Height 100 mm | Outside Ø (mm) | Quantity of material ($mm^3$) |
|---|---|---|---|
| 0.9 | 63.6 | 1.2 | 49.5 |
| 0.8 | 50.3 | 1.0 | 28.3 |
| 0.7 | 38.5 | 0.9 | 25.1 |
| 0.6 | 28.3 | 0.8 | 22.0 |
| 0.5 | 19.6 | 0.7 | 18.8 |
| 0.4 | 12.6 | 0.6 | 15.7 |
| 0.3 | 7.1 | 0.5 | 12.6 |
| 0.2 | 3.1 | 0.4 | 9.42 |

The use of a dip tube of small diameter offers a first advantage, namely that of quicker priming. Specifically, given that the dip tube defines an internal volume that is smaller, it fills with fluid more quickly than does a conventional dip tube. For example, for a conventional pump that dispenses doses of 70 microliters (μL) and that presents a dead volume of 90 μL, it is necessary to actuate six to seven times in order to prime the pump. With a dip tube of the invention that presents an outside diameter of 0.6 mm and an inside diameter of 0.4 mm, the number of priming strokes that are necessary is reduced to four, i.e. a reduction of two to three priming strokes.

It should also be observed that for a conventional dip tube having an inside diameter of 0.9 mm and an outside diameter of 1.2 mm, the quantity of material used is 49.5 cubic millimeters ($mm^3$) for a height of 10 centimeters (cm). With a dip tube having an inside diameter of 0.4 mm and an outside diameter of 0.6 mm, the quantity of material used is only 15.7 $mm^3$. Thus, for an inside diameter ratio of almost 2, the ratio for the quantity of material used is more than 3. Consequently, by means of the invention, it is possible to make a dip tube for which the cost of its constituent material is reduced by a factor of 3.

The dip tube of the invention may even be made of polyethylene or polypropylene, e.g. with an outside diameter of 0.6 mm, and still be fairly invisible when inserted into a fluid reservoir. Specifically, the naked human eye has difficulty perceiving or discerning items having a size of less than 1 mm. As a result, the dip tube of the invention, although visible, cannot be perceived or discerned. This is also explained by the fact that the dip tube is arranged in a fluid reservoir that is filled with liquid, and by the fact that polyethylene or polypropylene nevertheless is translucent even though not totally transparent. Consequently, instead of using expensive fluoropolymer, it is possible, in the context of the invention, to use a conventional polyethylene or polypropylene with an invisibility effect that is satisfactory.

As explained above, the dip tube 2 of the present invention presents an outside diameter that is relatively or considerably smaller than the inside diameter of the intake socket 12, which is conventionally 1.2 mm. In order to fasten the dip tube 2 of the invention in a conventional intake socket 12, the present invention provides a reducer sleeve 3 in which one end 21 of the dip tube 2 is engaged, the reducer sleeve 3 also being engaged axially in the intake socket 12 of the body 11, so that fluid communication is established between the dip tube 2 and the chamber 15 of the body 11. As its name indicates, the function of the reducer sleeve is to make it possible to fasten the dip tube in the socket 12 despite the difference in diameter between the two elements.

In FIG. 2, it can be seen that the reducer sleeve 3 comprises a sheath 31 that defines an outer bearing surface 31*b*, and a collar 33 of greater diameter. At its opposite end, the reducer sleeve forms an engagement cone 34 with a hole 35 opening out in its apex, which hole extends in line with the hollow inside of the sleeve. In FIGS. 3*a* and 3*b*, it can be seen that the reducer sleeve 31 also includes an inner bearing surface 31*a* to which the hole 35 is connected so as to form an inner shoulder 35*a*. The hole 35 defines a diameter that is less than the diameter of the inner bearing surface 31*a*. At its bottom end, the bearing surface 31*a* flares outwards so as to form an insertion cone 32 that extends into the inside of the bearing collar 33. In this embodiment, the inner and outer bearing surfaces 31*a*, 31*b* are completely cylindrical and circular.

The first step consists in engaging the end 21 of the dip tube 2 inside the reducer sleeve 3 by inserting it through the insertion cone 32, the purpose of which is to make it easier to insert the tube into the sleeve. The dip tube 2 is engaged in this way inside the sheath 31 that forms the inner bearing surface 31*a*. Advantageously, the dip tube is inserted inside the bearing surface 31*a* without friction, or in any event without excessive friction. Specifically, given that the dip tube 2 presents a small diameter, it also presents greater flexibility, and consequently a certain degree of fragility. In order to avoid damaging it while inserting it into the reducer sleeve 3, it is thus preferable to avoid inserting it by force, and on the contrary to insert it gently. It is even possible to envisage that the dip tube 2 is inserted inside the inner bearing surface 31*a* without any friction. In other words, the dip tube 2 may be engaged by merely sliding inside the bearing surface 31*a*, without any radial clamping. This is represented in FIG. 3*b* by a small space or gap between the dip tube 2 and the bearing surface 31*a*. However, the dip tube 2 could be inserted inside the reducer sleeve 3 with a certain amount of force. When the dip tube 2 is engaged fully in the inner bearing surface 31*a*, it comes into abutment against the shoulder 35*a*. Once the operation of inserting the dip tube has been performed, the assembly is inserted into the intake socket 12. More precisely, the reducer sleeve 3 is engaged in the socket 12, such that the outer bearing surface 31*b* of its sheath 31 comes into radial clamping contact with the inner bearing surface 12*a* of the socket 12. This is shown in FIGS. 4*a* and 4*b*. To this end, it should be observed that the inner bearing surface 12*a* of the socket 12 may be made with annular ribs 12*b* that have the function of increasing the grip on the reducer sleeve 3 inside the socket 12. The radial clamping provided by the socket 12 on the reducer sleeve 3 is such that said reducer sleeve is deformed radially at its inner bearing surface 31*a* that is in contact with the dip tube 2. This is represented in somewhat exaggerated manner in FIG. 4*b*, in which it can be seen that the dip tube is deformed radially and even presents a reduced diameter. The radial deformation of the reducer sleeve 3 is naturally induced by being held in the socket 12, but also by the material constituting the sleeve 3 presenting a certain amount of flexibility or capacity to deform. To this end, the sleeve 3 may be made of polyethylene or of polypropylene, for example. In order to make it easier to insert the reducer sleeve 3 in the socket 12, said socket may form an insertion bevel 12*c* at its inlet, which insertion bevel co-operates with the engagement cone 34 that is situated at the top end of the sleeve.

Reference is made below to FIGS. 5*a* and 5*b* in order to describe a second embodiment for the reducer sleeve. The reducer sleeve 3' differs from the reducer sleeve 3 in that its inner bearing surface 31*b* of the sheath 31 is stepped in such a manner as to define two bearing surface sections having diameters that are different. More precisely, the outer bearing surface 31*b* defines a bottom section 31*e* of greater diameter and a top section 31*d* of smaller diameter, the two sections being interconnected via a transition section 31*c* that may be frustoconical, for example. When the reducer sleeve 3' is force-fitted in the intake socket 12, radial deformation is greater in the bottom section 31*e* than in the top section 31*d*. As a result, the radial clamping of the dip tube 2 is greater in the bottom section 31*e* than in the top section 31*d*. This can be seen clearly in FIG. 5*b*. Thus, the dip tube 2 is strangled, so to speak, in the bottom section 31*e*, while it remains in its normal state at either end, and in particular in the top section 31*d*, thus reinforcing the grip of the dip tube 2 inside the reducer sleeve 3'. It can thus be said that the bottom section 31*e* of greater diameter performs a function of radially clamping the dip tube 2 locally in order to anchor it more securely in the reducer sleeve 3'.

FIG. 6 shows another embodiment for a reducer sleeve 3". In order to improve its capacity to deform radially, an axial slot is provided that extends from the bearing collar 33 and through the insertion cone 32 until it enters into the sheath 31. It can be seen that the slot 36 stops substantially half-way up the height of the sheath 31, and does not extend as far as the engagement cone 34. While the reducer sleeve 3" is being forced into an intake socket 12, the width of the slot 36 decreases, thus generating greater and localized radial clamping of the dip tube 2.

FIG. 7 shows yet another embodiment for a reducer sleeve 3''' that is also formed with a slot 37 that extends from the hole 35 and through the engagement cone 34 until it enters into the sheath 31. The slot 37 does not extend as far as the insertion cone 32 or the bearing collar 33. As in the preceding embodiment, the width of the slot 37 decreases when the reducer sleeve 3''' is force-fitted in an intake socket 12, in such a manner as to create greater local radial clamping on a dip tube.

FIGS. 8*a* and 8*b* show a reducer sleeve 3'''' in a fourth embodiment of the invention. It can be seen that the sheath 31 and a portion of the engagement cone 34 have been notched, truncated, or cut away at the inner bearing surface 31*a*, in such a manner as to define an edge 38 that borders and terminates the inner bearing surface 31*a*. With reference to FIG. 8*b*, it can be seen that the end 21 of the dip tube 2 extends until it is in abutment with the shoulder 35*a*, such that it extends beyond the edge 38 formed at the notch of the sheath 31. Given that the dip tube is subjected to radial deformation by the bearing surface 31*a*, and is subjected to practically no stress at the notch, i.e. beyond the edge 38, the dip tube deforms a little around the edge 38, and thus forms a solid anchor or stop line. As a result, in this embodiment, the radial clamping of the dip tube generates axial anchoring at the edge 38.

In all of the embodiments described above, the dip tube 2 is held in the reducer sleeve by radial clamping, advantageously while engaging the reducer sleeve in the intake socket. In a variant or in addition, it can also be envisaged to perform bonding, e.g. by ultrasound or by laser, between the dip tube and the reducer sleeve. Provision could also be made to overmold the reducer sleeve on the dip tube.

The invention thus provides a dip tube of small diameter that is barely visible, if at all, as a result of its fineness, and that, as a result, uses very little constituent material. It is fastened in a conventional intake socket by means of a reducer sleeve that is force-fitted in the intake socket 12, and that holds the dip tube by radial clamping, by heat-sealing, and/or by overmolding.

The invention claimed is:

1. A fluid dispenser member, comprising a body for mounting in the opening of a fluid reservoir so as to take fluid therefrom, the body comprising a fluid chamber that defines a fluid inlet in the form of a socket that presents an inside diameter of about 1.2 mm, the dispenser member including a dip tube for extending into the fluid reservoir so as to take fluid therefrom, the dispenser member further comprising a reducer sleeve that internally receives an end of the dip tube, and that is engaged axially in the socket of the body, such that fluid communication is established between the dip tube and the chamber of the body;

wherein the dip tube presents an outside diameter that is less than 1 mm, the dip tube is made of a material that is transparent or translucent, and in that the reducer sleeve is radially deformable, such that engaging the reducer sleeve in the socket increases the clamping of the reducer sleeve around the dip tube; and wherein the reducer sleeve defines an outer bearing surface that is engaged with an inner bearing surface of the socket, the outer bearing surface being stepped, thereby defining at least two sections having diameters that are different.

2. The dispenser member according to claim 1, wherein the dip tube presents an outside diameter lying in the range about 0.8 mm to 0.6 mm.

3. The dispenser member according to claim 1, wherein the end of the dip tube is inserted substantially without friction into the reducer sleeve, before the reducer sleeve is engaged in the socket.

4. The dispenser member according to claim 1, wherein the reducer sleeve is slotted axially.

5. The dispenser member according to claim 1, wherein the reducer sleeve forms a transverse edge against which the dip tube is deformed and thus held.

6. The dispenser member according to claim 1, wherein the reducer sleeve includes an engagement cone, and the socket includes an insertion bevel to facilitate fitting the reducer sleeve in the socket.

7. A method of assembling the dispenser member according to claim 1, the reducer sleeve being radially deformable, such that engaging the reducer sleeve in the socket increases the clamping of the reducer sleeve around the dip tube, the method comprising firstly inserting the dip tube substantially without friction into the reducer sleeve, then secondly engaging the reducer sleeve with the dip tube in the socket.

8. The dispenser member according to claim 1, wherein the dispenser member is a pump.

9. The dispenser member according to claim 1, wherein the reducer sleeve comprises:

a hollow sheath in which the end of the dip tube is received, the hollow sheath coming into radial engagement in the socket;

an insertion cone to facilitate inserting the dip tube into the hollow sheath; and a bearing collar that comes into axial abutment against the socket.

10. The dispenser member according to claim 9, wherein only the reducer sleeve is slotted axially.

11. The dispenser member according to claim 9, wherein the bearing collar, the insertion cone, and the hollow sheath are slotted axially.

12. A fluid dispenser member, comprising a body for mounting in the opening of a fluid reservoir so as to take fluid therefrom, the body comprising a fluid chamber that defines a fluid inlet in the form of a socket that presents an inside diameter of about 1.2 mm, the dispenser member including a dip tube for extending into the fluid reservoir so as to take fluid therefrom, the dispenser member further comprising a reducer sleeve that internally receives an end of the dip tube, and that is engaged axially in the socket of the body, such that fluid communication is established between the dip tube and the chamber of the body;

wherein the dip tube presents an outside diameter that is less than 1 mm, the dip tube is made of a material that is transparent or translucent, and in that the reducer sleeve is radially deformable, such that engaging the reducer sleeve in the socket increases the clamping of the reducer sleeve around the dip tube; and wherein the dip tube is bonded in the reducer sleeve.

13. The dispenser member according to claim 12, wherein the dip tube presents an outside diameter lying in the range about 0.8 mm to 0.6 mm.

14. The dispenser member according to claim 12, wherein the end of the dip tube is inserted substantially without friction into the reducer sleeve, before the reducer sleeve is engaged in the socket.

15. The dispenser member according to claim 12, wherein the reducer sleeve is slotted axially.

16. The dispenser member according to claim 12, wherein the reducer sleeve forms a transverse edge against which the dip tube is deformed and thus held.

17. The dispenser member according to claim 12, wherein the reducer sleeve comprises:

a hollow sheath in which the end of the dip tube is received, the hollow sheath coming into radial engagement in the socket;

an insertion cone to facilitate inserting the dip tube into the hollow sheath; and a bearing collar that comes into axial abutment against the socket.

18. The dispenser member according to claim 12, wherein the reducer sleeve includes an engagement cone, and the socket includes an insertion bevel to facilitate interfitting the reducer sleeve in the socket.

19. A method of assembling the dispenser member according to claim 12, the reducer sleeve being radially deformable, such that engaging the reducer sleeve in the socket increases the clamping of the reducer sleeve around the dip tube, the method comprising firstly inserting the dip tube into the reducer sleeve, then secondly engaging the reducer sleeve with its dip tube in the socket.

20. The dispenser member according to claim 12, wherein the dispenser member is a pump.

21. A fluid dispenser member, comprising a body for mounting in the opening of a fluid reservoir so as to take fluid therefrom, the body comprising a fluid chamber that defines a fluid inlet in the form of a socket that presents an inside diameter of about 1.2 mm, the dispenser member including a dip tube for extending into the fluid reservoir so as to take fluid therefrom, the dispenser member further comprising a reducer sleeve that internally receives an end of the dip tube, and that is engaged axially in the socket of the body, such that fluid communication is established between the dip tube and the chamber of the body;

wherein the dip tube presents an outside diameter that is less than 1 mm, the dip tube is made of a material that is transparent or translucent, and in that the reducer sleeve is radially deformable, such that engaging the reducer sleeve in the socket increases the clamping of the reducer sleeve around the dip tube; and wherein the reducer sleeve is overmolded on the dip tube.

22. The dispenser member according to claim 21, wherein the dip tube presents an outside diameter lying in the range about 0.8 mm to 0.6 mm.

23. The dispenser member according to claim 21, wherein the end of the dip tube is inserted substantially without friction into the reducer sleeve, before the reducer sleeve is engaged in the socket.

24. The dispenser member according to claim 21, wherein the reducer sleeve is slotted axially.

25. The dispenser member according to claim 21, wherein the reducer sleeve forms a transverse edge against which the dip tube is deformed and thus held.

26. The dispenser member according to claim 21, wherein the reducer sleeve comprises:

a hollow sheath in which the end of the dip tube is received, the hollow sheath coming into radial engagement in the socket;

an insertion cone to facilitate inserting the dip tube into the hollow sheath; and a bearing collar that comes into axial abutment against the socket.

27. The dispenser member according to claim 21, wherein the reducer sleeve includes an engagement cone, and the socket includes an insertion bevel to facilitate interfitting the reducer sleeve in the socket.

28. A method of assembling the dispenser member according to claim 21, the reducer sleeve being radially deformable, such that engaging the reducer sleeve in the socket increases the clamping of the reducer sleeve around the dip tube, the method comprising firstly inserting the dip tube into the reducer sleeve, then secondly engaging the reducer sleeve with its dip tube in the socket.

29. The dispenser member according to claim 21, wherein the dispenser member is a pump.

* * * * *